United States Patent [19]

Bosnak

[11] 4,321,507

[45] Mar. 23, 1982

[54] STROBE POWER SUPPLY

[75] Inventor: John J. Bosnak, Old Saybrook, Conn.

[73] Assignee: Austin Electronics, Inc., Deep River, Conn.

[21] Appl. No.: 162,151

[22] Filed: Jun. 23, 1980

Related U.S. Application Data

[63] Continuation of Ser. No. 962,684, Nov. 21, 1978, abandoned.

[51] Int. Cl.[3] ..... H05B 41/29; H05B 41/34

[52] U.S. Cl. ..... 315/241 R; 315/200 A; 315/224; 320/1; 331/109; 363/19

[58] Field of Search ..... 315/200 A, 209 R, 219, 315/224, 241 R, 241 P; 320/1; 331/107 R, 108 R, 109; 363/18-21

[56] References Cited

U.S. PATENT DOCUMENTS

| | | | |
|---|---|---|---|
| 3,515,973 | 6/1970 | Powell | 320/1 |
| 4,013,921 | 3/1977 | Corthell | 315/241 R |
| 4,027,199 | 5/1977 | Johnson | 315/241 R |

*Primary Examiner*—Eugene La Roche
*Attorney, Agent, or Firm*—Fishman and Van Kirk

[57] ABSTRACT

A power supply, including a static inverter, which is suited for the periodic energization of a flash tube. The static inverter may be turned off during periods when a capacitive load charged thereby is being discharged through the flash tube. The power supply has the capability of causing two successive ionizations of a flash tube within a short time period and may include both over-current and over-voltage protection in the form of sensing circuits which disable the static inverter.

38 Claims, 1 Drawing Figure

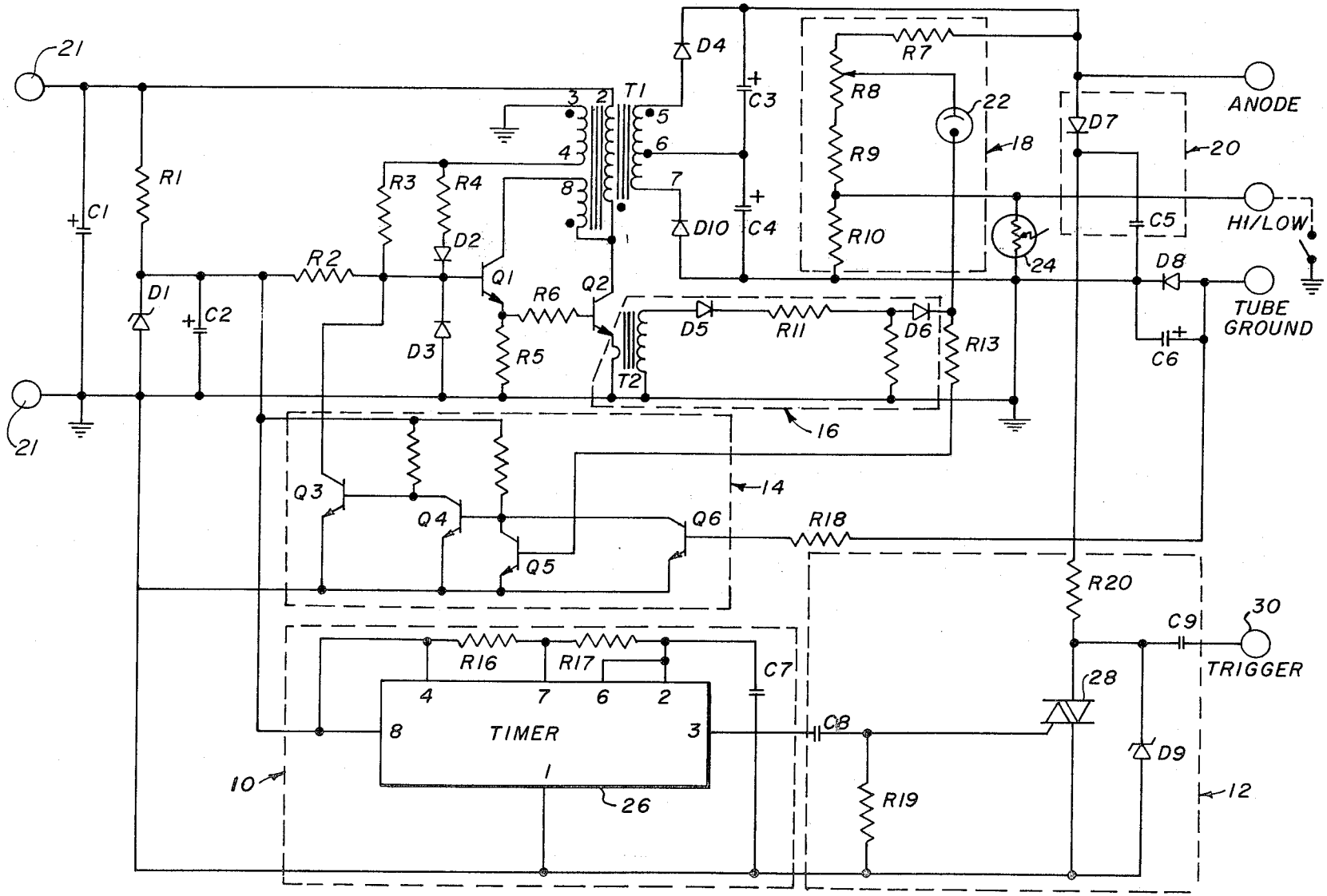
ANODE
HI/LOW
TUBE GROUND
TRIGGER
TIMER
20
18
22
24
12
16
14
10
26
28
30
21
T1
T2
Q1
Q2
Q3
Q4
Q5
Q6
D1
D2
D3
D4
D5
D6
D7
D8
D9
D10
C1
C2
C3
C4
C5
C6
C7
C8
C9
R1
R2
R3
R4
R5
R6
R7
R8
R9
R10
R11
R13
R16
R17
R18
R19
R20

STROBE POWER SUPPLY

This is a continuation of application Ser. No. 962,684, filed Nov. 21, 1978, now abandoned.

BACKGROUND OF THE INVENTION (1) Field of the Invention

The present invention relates to the delivery of power to an intermittently energized load. More particularly, this invention is directed to power supplies for gaseous discharge tube devices. Accordingly, the general objects of the present invention are to provide novel and improved methods and apparatus of such character.

(2) Description of the Prior Art

While not limited thereto in its utility, the present invention has been found to be particularly well suited for controlling the operation of warning lights and particularly for use in warning light systems which employ xenon flash tubes. Such warning light systems are well known in the art and find application on emergency vehicles, aircraft and in other installations where it is considered necessary or desirable to attract attention by means of the generation of intermittent bursts of energy in the visible range of the frequency spectrum. For disclosure of prior art devices for controlling the energization of flash tubes, reference may be had to U.S. Pat. Nos. 3,515,973 and 4,013,921; both of these prior patents being assigned to the assignee of the present invention.

As discussed in U.S. Pat. No. 4,013,921, visibility of a warning light system may be enhanced by causing the lamp employed therein to be ionized twice in rapid succession. Electronic flash tubes, xenon tubes for example, produce a burst of light which is of comparatively short duration although the intensity of the light generated is extremely high. Thus, by causing the tube to flash twice in rapid succession, and thereafter have the customary dwell time which constitutes the major portion of the operational cycle, visibility will be enhanced since the net effect will either be a flash which appears to be of longer duration or a discernable double flash which aids in "fixing" the location of the light source.

Prior power supplies which have been suitable for use with flash tubes which are to be controlled to produce spaced groups of multiple flashes have been characterized by certain deficiencies. One of the more significant of these deficiencies resides in the fact that the prior power supplies were characterized by comparatively high power consumption and, incident thereto, the generation of a considerable amount of heat which had to be dissipated. This high power consumption and heat generation resulted from poor switching characteristics of the semiconductors through which current was delivered to a static inverter transformer primary winding, especially during "turn-off". High power consumption also resulted from an inability to disable the power supply (1) during the times that the flash tube was in the ionized state or (2) in response to the sensing of a current in excess of a predetermined safe amount or (3) in response to the sensing of an output voltage in excess of a preselected level.

To further discuss the poor switching characteristics of prior art power supplies, the current through the static inverter's power transformer was often controlled by a "power" transistor which was turned off by being current starved rather than being controlled so as to switch off cleanly and sharply. Operation in a current starvation mode resulted in an increase in the temperature to which the semiconductor device was subjected. Accordingly, it has previously been common practice to employ a pair of "power" transistors in parallel.

A further disadvantage of prior art power supplies suitable for use with intermittently energized loads resided in the fact that the active components, particularly the "power" transistor or transistors, had to be matched to the passive circuit components to insure against overdriving of the semiconductors. Thus, each power supply had to be tested in an effort to avoid drawing excessive current while insuring that the "power" transistors, when conductive, would operate in the region of saturation to minimize resistance and thus minimize heat generation.

A further disadvantage of prior art supplies designed for use with flash tubes resided in the inability to adjust the output of the power supply such that the intensity of the burst of light produced could be varies as a function of the ambient lighting conditions.

SUMMARY OF THE INVENTION

The present invention overcomes the above briefly-discussed and other deficiencies and disadvantages of the prior art by providing a novel and improved method of and apparatus for delivering power to and controlling the operation of intermittently energized loads and particularly flash tube light sources.

In accordance with a first embodiment of the invention, the periodic flow of current through the primary winding of a power transformer is controlled by a solid state switch; i.e., a transistor operated in a power switch mode; connected in series with the transformer winding. This switching transistor will be turned off, thereby disabling the static inverter, in response to a signal provided by a de-ionization circuit during the time periods that a flash tube load supplied by the power supply is in the conductive state.

Also in accordance with a preferred embodiment of the invention, a triac is employed in combination with a timing pulse generator to produce, in a preferred embodiment, closely spaced trigger pulse pairs for application to a flash tube load. The triac, which is a gate controlled solid state device, will switch from the nonconductive to conductive states in response to the application to the gate thereof of either a positive or negative going pulse. Accordingly, the output of a single multivibrator is coupled to the triac, by means of a pulse shaping circuit, to produce trigger pulses coincident with the setting and resetting of the multivibrator.

In the case where the load on the power supply comprises a flash tube, the static inverter will charge a capacitance connected across the secondary winding of a power transformer. In accordance with another embodiment of the invention, the voltage across the capacitance is sensed and a signal commensurate therewith employed for the purpose of disabling the aforementioned switching transistor in series with the power transformer primary winding. Thus, the maximum charge stored in the capacitance connected across the power transformer secondary winding may be selected. Additionally, by connecting a light sensitive device in parallel with a resistor in the output voltage sensing circuit, the maximum charge on the capacitance may be automatically varied as a function of the ambient light. A signal indicative of the fact that the charge on the capacitance has reached the maximum desired level, in a preferred embodiment, will be generated by a clamping circuit including a neon lamp which will ionize when the desired voltage level is reached; the switching transistor being disabled in response to the ionization of the neon lamp.

The power supply in accordance with the present invention may also employ a current sensing circuit which includes a transformer having its primary winding connected in series with the aforementioned switching transistor. A circuit connected across the secondary winding of the current sensing transformer will provide an output signal indicative of the current flow through the switching transistor and the switching transistor will be disabled in response to this output signal when a current in excess of the maximum desired current is sensed. Use of a current sensing circuit permits the switching transistor to be turned on hard over a range of supply voltages, reduces the heat which must be dissipated in the circuit and reduces the number of elements in the circuit by eliminating the need for using parallel connected power transistors. The current sensor also eliminates the need for matching the active and passive circuit components.

Also in accordance with a preferred embodiment of the invention, control of the switching transistor is effected in such a manner that, rather than being turned off by being current starved, the transistor is positively controlled to produce clean and sharp switching to the nonconductive state.

A further novel feature of the present invention, when employed to control the operation of a flash tube, resides in a trigger storage circuit which provides a substantially constant voltage for triggering purposes; i.e., the trigger voltage source is not discharged through the flash tube when the latter is conducting.

BRIEF DESCRIPTION OF THE DRAWING

The present invention may be better understood and its numerous objects and advantages will become apparent to those skilled in the art by reference to the accompanying drawing which is an electrical circuit schematic diagram of a preferred embodiment of a power supply in accordance with the invention.

DESCRIPTION OF THE PREFERRED EMBODIMENT

With reference now to the drawing, the present invention is depicted as it may be used to control the ionization of a xenon flash tube. The flash tube and its associated trigger voltage transformer have been omitted from the drawing since they do not comprise part of the invention. The principal subsystems of a power supply in accordance with the present invention include, in addition to the static inverter circuit which produces a periodic flow of current through a power transformer T1, a timing circuit indicated generally at 10 which delivers control pulses to a trigger circuit indicated generally at 12. A power supply in accordance with the invention also includes, as a principal subsystem, a control amplifier which has been indicated generally at 14. Control amplifier 14, in response to signals provided by a current sensor 16 and a voltage sensor 18, exercises on-off supervision over the operation of the inverter circuit. The power supply further includes a trigger storage circuit indicated generally at 20.

Operation of the power supply is initiated by the application of a DC voltage across input terminals 21. An input voltage, after filtering by input capacitor C1, is delivered via the primary winding of power transformer T1 to the collectors of drive transistor Q1 and power transistor Q2. The input voltage is also applied across a series circuit comprising resistor R1 and Zener diode D1. A smoothing capacitor C2 is connected across diode D1 to further filter the regulated voltage which will, in the manner known in the art, appear across diode D1. This regulated voltage is delivered to timing circuit 10 and to control amplifier 14. The regulated voltage provided by diode D1 is also, via starting resistor R2, applied to the base of drive transistor Q1.

Upon application to the input terminals of a DC voltage of the requisite magnitude, a small base current will be supplied to drive transistor Q1 via starting resistor R2 thereby causing transistor Q1 to conduct. Conduction of transistor Q1 will, in turn, cause conduction of power transistor Q2; a bias voltage being developed across resistor R5 when transistor Q1 conducts and base current being supplied to transistor Q2 via resistor R6. When power transistor Q2 is turned on, the resulting current flow through the primary winding of power transformer T1 will induce a voltage in the feedback winding of the transformer such that a positive potential will appear at terminal 4 of the feedback winding. This positive voltage is applied, via resistors R3 and R4 and diode D2, to the base of transistor Q1 driving transistor Q1 into saturation. Transistor Q2, in the manner described above, will thus also be driven into saturation. It is to be noted that terminal 1 of the primary winding of power transformer T1 will be at a negative potential when power transistor Q2 is in the conductive state and the polarity of the voltage induced across the secondary winding of the power transformer will be such that a negative potential will appear at terminal 5 and a positive potential at terminal 7. At this time; i.e., with transistor Q2 in the saturated state, diodes D4 and D10 will be reverse biased and no current will be drawn from the secondary winding of transformer T1.

The primary winding of a current sensing transformer T2 is connected in series with power transistor Q2. The primary winding of transformer T2 may, for example, consist of a single turn. The current through transistor Q2 will, subsequent to Q2 being biased into the conductive state, increase at a linear rate. Through the action of current sensing transformer T2, the voltage at the junction of a diode D6 and resistor R13; i.e., the output signal from current sensing circuit 16; will simultaneously increase. When the voltage at the junction of diode D6 and resistor R13 reaches a predetermined level, the inverter will be turned off in the manner to be described below and thus a peak current, which will not be of sufficient magnitude to cause damage to any of the circuit components, will not be exceeded.

The control amplifier 14 includes transistors Q3, Q4, Q5 and Q6. Transistors Q3, Q5 and Q6 are normally nonconductive while transistor Q4 is normally conductive. The collector of transistor Q3 is connected directly to the base of drive transistor Q1 which, in the manner described above, controls the state of power transistor Q2. Considering the overcurrent protection discussed above, the voltage commensurate with current flow through transistor Q2, which appears at the junction of diode D6 and resistor R13, is applied to the base of transistor Q5. When this voltage reaches a level commensurate with the maximum current to be permitted, transistor Q5 will be turned on thereby removing drive from the base of transistor Q4 and turning transistor Q4 off. When transistor Q4 becomes nonconductive, the clamp will be removed from the base of transistor Q3 turning transistor Q3 on and shorting the base of drive transistor Q1 to ground. Transistor Q1 will thus be turned off and, when transistor Q1 turns off, the power transistor Q2 will be quickly and cleanly switched back to a nonconductive state.

When transistors Q1 and Q2 are switched off, regeneration will occur in power transformer T1. When the electromagnetic field produced by current flow through the primary winding of transformer T1 begins to collapse, the polarity of all of the transformer windings will be reversed with respect to the polarity as described above. Thus, terminal 4 of the feedback winding will go negative and the polarity of the voltage induced in the transformer secondary winding will reverse with terminal 5 assuming a positive polarity and terminal 7 assuming a negative polarity. The negative voltage at terminal 4 of the feedback winding of transformer T1 will be applied to the base of drive transistor Q1 thus enhancing switching speed and resulting in less heating of the drive and power transistors. Diode D3 will, when terminal 4 of the feedback winding of transformer T1 goes negative, clamp the base of drive transistor Q1 at a negative 0.6 volts.

When the polarity of the voltage induced in the secondary winding of transformer T1 reverses, with the interruption of current flow through the transformer primary winding caused by the switching of transistors Q1 and Q2 to the nonconductive state, the energy stored in the primary winding of the transformer will be transferred into a storage capacitance defined by electrolytic capacitors C3 and C4. In the disclosed embodiment, where the secondary winding of transformer T1 is center-tapped, each of capacitors C3 and C4 may be charged independently of the other; the cathode of capacitor C3 being connected to the center tap 6 of transformer T1 and the anode of capacitor C4 being connected to center tap 6. Capacitor C3 will be charged when the polarity across the transformer secondary winding is such that diode 4 is forward biased while capacitor C4 will be charged when diode D10 is conductive.

When the energy in the primary winding of power transformer T1 is dissipated, the polarity of the voltages across the transformer winding will again reverse, i.e., the voltages at the transformer terminals will again assume the same polarities as they had upon the initial application of power to the system as described above. Thus, terminal 4 of the feedback winding will again have a positive potential and transistors Q1 and Q2 will again be turned on and driven into saturation. A new power cycle thus begins. It is to be noted that only a small charge will be placed on capacitors C3 and C4 during each cycle of the inverter and a number of cycles will be required to charge the capacitors to the potential requisite for operating the load. It is also to be noted that, in the case of a xenon flash tube load, the frequency of operation of the inverter will be much higher than the frequency of firing of the flash tube.

In accordance with the present invention, the voltage across series connected capacitors C3 and C4 is clamped to a predetermined level. The output voltage sensing circuit, indicated generally at 18, includes a voltage divider defined by resistors R7, R9 and R10 and a potentiometer R8. Potentiometer R8 will be adjusted to define the maximum level the voltage across capacitors C3 and C4 can reach. The voltage control circuit also includes a neon lamp 22 which is connected between the wiper arm of potentiometer R8 and, via resistor R13, the base of transistor Q5 of control amplifier 14. In the operation of the disclosed embodiment the junction of resistors R9 and R10 of the voltage divider will be connected to ground by an external HI/LOW switch and potentiometer R8 will be adjusted such that the voltage which will appear on the wiper arm is commensurate with the maximum charge to be stored in capacitors C3 and C4. The charging of the storage capacitors C3 and C4 will continue during each power cycle until the preselected maximum voltage across the capacitors is reached. When this selected maximum voltage across the storage capacitors is reached, the ignition voltage for neon tube 22 will appear at the wiper arm of potentiometer R8 and tube 22 will thus conduct. Conduction of neon tube 22 will result in current flow to the base of transistor Q5 of power amplifier 14 thus turning on transistor Q5. In the manner described above, conduction of transistor Q5 will result in transistor Q4 being rendered nonconductive and transistor Q3 being turned on thus shunting the base of drive transistor Q1 to ground. Accordingly, drive transistor Q1 and power transistor Q2 will be turned off and will be held off as long as neon tube 22 is ionized. The inverter will be held in the off condition until capacitors C3 and C4 are discharged primarily by leakage through the voltage divider of voltage sensor circuit 18. In a typical case, the ignition voltage for neon tube 22 will be 115 volts while the de-ionization potential of the lamp will be approximately 80 volts. Thus, again considering the use of the power supply of the present invention to control the operation of a xenon flash tube or tubes, after shut-down occurs under control of the voltage sensor, if the flash tube is not triggered into conduction the voltage on the storage capacitors will decrease slowly until the voltage across the neon lamp reaches approximately 80 volts. The neon lamp will then deionize and no current will flow to the base of transistor Q5. Transistor Q5 will thus turn off, turning on transistor Q4 which in turn turns off transistor Q3. When transistor Q3 becomes nonconductive, the ground is removed from the base of drive transistor Q1 and base drive returns to this semiconductor turning on transistor Q1 which in turn turns on power transistor Q2 whereupon the normal switching action of the static inverter will resume. When the jumper to ground is removed from the junction of resistors R9 and R10 of the voltage divider of voltage sensing circuit 18, for example by opening the external HI/LOW switch, the "voltage clamp" will revert to a lower voltage. Thus, by employing a switch between the junction of resistors R9 and R10 and ground, the power supply may selectively be adjusted to produce a first high output voltage level with the switch closed and a second lower output voltage level with the switch open. The different output levels; i.e., the different levels to which the capacitors C3 and C4 are charged; also represent different levels of power consumption and, with a flash tube load, different brightness levels. The switch between the junction of resistors R9 and R10 and ground may thus be used for day/night operation of a warning lamp where greater output power is required during the daylight hours. This day/night compensation may be accomplished automatically by connecting a light sensitive resistor 24, for example a cadmium photocell, in parallel with resistor R10 whereby the effective resistance between the junction of resistors R9 and R10 and ground will automatically vary as a function of the light incident upon the photocell 24.

As discussed above, the application of power to the circuit by connecting a direct current source across input terminals 21 will result in the application of a regulated voltage, as developed across Zener diode D1, to the timing circuit 10. In accordance with a preferred embodiment, the timing circuit 10 comprises an integrated circuit such as a Signetics type 555 timer. The regulated DC voltage is applied to pins 4 and 8 of the timer and the frequency of operation of the timer is determined by external resistors R16 and R17 and capacitor C7. When the charge on capacitor C7 reaches $\frac{2}{3}$ of the supply voltage, an internal flip-flop of the timer will be set thereby causing a positive voltage to appear on output pin 3. When the timer is reset as will be discussed below, the positive signal is removed from pin 3. Timer pin 3 is coupled, via a differentiator circuit comprising capacitor C8 and resistor R19, to the gate of a triac 28. The differentiator generates pulses, for application to triac 28, which correspond to the leading and trailing edges of the signal which appears at output pin 3 of timer 26 as its internal flip-flop is set and reset.

As previously discussed, the disclosed embodiment of the present invention has been designed for use in the control of warning lights, particularly xenon flash tubes, and thus includes a trigger storage circuit 20 comprising diode D7 and capacitor C5. Operation of the trigger storage circuit will be discussed below. During the charging of capacitors C3 and C4 a capacitor C9 in trigger circuit 12 will be charged via resistor R20 as a result of the conduction of diode D7. The level to which capacitor C9 is charged will be determined by Zener diode D9. Diode D9 also protects the triac from excessive voltage. With capacitor C9 charged, the application of either a positive or negative pulse to the gate of triac 28 from the differentiator C8, R19 will cause the triac to conduct. When the triac conducts, capacitor C9 will discharge through the primary winding of a trigger voltage transformer, not shown, connected between trigger terminal 30 and the flash tube ground. As is known in the art, the trigger voltage transformer will comprise a step-up transformer whereby the discharge of the capacitor C9 through the primary winding thereof will result in the induction of a very high voltage, 6000 volts for example, across the transformer secondary winding. Application of this high voltage to the flash tube will trigger the tube into conduction thus establishing a discharge path through the flash tube for capacitors C3 and C4.

When the flash tube load is triggered into conduction, thus establishing a discharge path for capacitors C3 and C4, the heavy current which flows through the flash tube will also flow through diode D8. There will, of course, be a small voltage drop across diode D8 and this small voltage drop, 0.8 for example, will be applied via resistor R18 to the base of normally nonconductive transistor Q6 of control amplifier 14. Transistor Q6 will thus be turned on thereby shorting the base of transistor Q4 to ground and causing transistor Q4 to turn off. As described above, the turning off of transistor Q4 will result in transistor Q3 being turned on and the inverter drive transistor Q1 thus being turned off. Accordingly, the shut-off pulse which results when the tube current begins to flow through diode D8 will insure that the power supply is turned off during the time the flash tube is conducting. A capacitor C6 is provided in parallel with diode D8 to bypass trigger pulses to ground thus protecting the diode against over-voltage.

When the flash tube de-ionizes, there will be no voltage drop across diode D8, and the power supply will be turned back on. Triac 28 is self-commutating in that it will automatically shut-off when the current through the device falls below the minimum holding current. Resistor R20 is selected to have a sufficiently high value so as to insure that the triac will be "starved" off; i.e., the current flow in the circuit comprising resistor R20 and diode D7 will be below the minimum holding current of the triac. However, the RC time constant of the circuit comprising resistor R20 and capacitor C9 must be short enough to insure that capacitor C9 will be sufficiently recharged, in the manner to be described below by the trigger storage circuit, before the occurrance of a second trigger pulse of a pair of such pulses as provided by timer 26 and the differentiator C8, R19.

The output of the timer 26, as it appears on pin 3, will remain positive during the above-described operation while timing capacitor C7 is being discharged through resistor R17. When the voltage across timing capacitor C7 reaches $\frac{1}{3}$ of the supply voltage, the internal flip-flop of timer 26 will be reset thereby causing the voltage on pin 3 to suddenly go to negative or to ground. This negative going signal is coupled, via the differentiator circuit C8, R19, to the gate of triac 28. The negative pulse thus applied to the triac will again trigger the triac into conduction whereby capacitor C9 will again discharge through the primary winding of the trigger transformer and the flash tube will be triggered into conduction producing a second flash. This second flash occurs a short time after the first or main flash. It is to be noted that the second flash will occur at a time when the capacitors C3 and C4 are not charged to the maximum voltage as slected by the setting of potentiometer R8. There will, however, be sufficient energy stored in capacitors C3 and C4 to produce the two successive, closely spaced flashes regardless of whether resistor R10 has been partly or totally short-circuited. The value of resistors R16, R17 and that of capacitor C7 of timing circuit 10 are selected such that the time period between the resetting of the internal flip-flop in timer 26 and the next setting of this device will be sufficient to allow capacitors C3 and C4 to be fully recharged.

The trigger storage circuit 20 provides a substantially constant voltage for charging capacitor C9. Thus, diode D7 prevents capacitor C5 from discharging through the flash tube load; C5 being charged through D7 at the same time as the initial charging of C9. After the flash tube has been "fired" in response to a positive trigger pulse, and capacitor C9 discharged through the trigger transformer and triac 28, capacitor C9 will be recharged by trigger storage circuit capacitor C5. Recharging to the requisite level, 200 volts for example, will occur before the timer provides the second pulse of a pulse pair. Capacitor C5 will typically provide approximately 500 volts for the purpose of recharging C9 after the first trigger pulse of a pair of closely spaced pulses.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for delivering current to an intermittently energized load comprising:

power transformer means, said power transformer means including a transformer having at least a primary winding, a secondary winding, a feedback winding, and a drive winding;

solid state switch means, said switch means including a first controllable semiconductor device connected in series with said power transformer means transformer primary winding;

control means for said solid state switch means, said control means including a second controllable semiconductor device connected in series with said power transformer means transformer drive winding, current flow through said second semiconductor device generating a control signal for said switch means;

means for connecting said control means to said switch means whereby the control signals provided by said control means will bias said first semiconductor device to a state of conduction commensurate with that of said second semiconductor device;

means connecting said power transformer means transformer feedback winding to said control means whereby a signal induced in said feedback winding will be delivered as a drive control signal to said control means, said drive control signal controlling the current flow through said second semiconductor device;

means for disabling said control means, said disabling means when energized removing said drive control signal from said control means whereby said second semiconductor device will be switched to a nonconductive state;

means for sensing the magnitude of current flow through said switch means first semiconductor device and generating a signal commensurate therewith, said current magnitude sensing means including a current transformer having a primary winding connected in series with said power transformer means transformer primary winding and said first semiconductor device, a signal commensurate with current flow through said first semiconductor device being generated in said current transformer secondary winding;

means responsive to said signal commensurate with current flow through said switch means first semiconductor device for providing a first energizing signal to said disabling means whereby said disabling means will cause said control means second semiconductor device to switch to a nonconductive state whenever the current flow through said first semiconductor device exceeds a predetermined level to thereby disable said switch means by removal of a drive control signal therefrom;

means for connecting said series connected transformer means transformer primary winding, said current transformer primary winding and said solid state switch means first semiconductor device across a source of direct current; and means for connecting a load across said transformer means transformer secondary winding.

2. The apparatus of claim 1 further comprising:

means for sensing the voltage across a load connected across said transformer means transformer secondary winding and for generating a signal commensurate therewith; and means for delivering said signal commensurate with load voltage as a second energizing signal to said disabling means whereby said switch means will be disabled whenever the voltage across the load exceeds a predetermined level.

3. The apparatus of claim 2 wherein the load is a capacitance subject to periodic discharge through a gaseous discharge tube and wherein said apparatus further comprises:

means connected to said voltage sensing means for sensing the ambient light conditions, said light sensing means varying said predetermined voltage level as a function of the ambient lighting conditions.

4. The apparatus of claim 2 wherein said apparatus further comprises:

means connected to said voltage sensing means for sensing the ambient light conditions, said light sensing means varying said predetermined voltage level as a function of the ambient light conditions.

5. The apparatus of claim 2 wherein said load is a capacitance subject to periodic discharge through a gaseous discharge tube and wherein said apparatus further comprises:

timer means for producing output pulses having a preselected repetition rate and duration; and means responsive to said timer means output pulses for causing ionization of the discharge tube whereby the capacitance will discharge therethrough.

6. The apparatus of claim 5 wherein sad means for causing ionization of the discharge tube comprises:

a triac;

first capacitor means connected to be discharged through said triac to cause generation of a discharge tube ionization producing signal; and pulse shaping means for coupling the timer means output pulses to said triac whereby said triac is rendered conductive on the leading and trailing edges of said timer means output pulses.

7. The apparatus of claim 5 wherein said apparatus further comprises:

means connected to said voltage sensing means for sensing the ambient light conditions, said light sensing means varying said predetermined voltage level as a function of the ambient lighting conditions.

8. The apparatus of claim 7 wherein said means for causing ionization of a gaseous discharge tube comprises:

a triac;

capacitor means connected to be discharged through said triac to cause generation of a flash tube ionization producing signal; and pulse shaping means for coupling the output of said timer means to said triac whereby said triac will be rendered conductive in synchronism with the leading and trailing edges of said timer means output pulses.

9. The apparatus of claim 1 further comprising:

means for sensing the current flow through a load connected across said transformer secondary winding when the load is energized and for generating a signal commensurate therewith; and means for delivering said signal commensurate with load current as an energizing signal to said disabling means whereby said switch means will be disabled when a load supplied by said apparatus is in the energized state.

10. The apparatus of claim 1 further comprising:

timer means for producing output pulses have a preselected repetition rate and duration; and means responsive to said timer means output pulses for causing the intermittent energization of a load connected across the transformer means transformer secondary winding.

11. The apparatus of claim 10 wherein the load is a capacitance subject to periodic discharge through a gaseous discharge tube and wherein said means for causing the intermittent energization of the load comprises:

a pair of normally nonconductive gate controlled solid state silicon thyristors connected in an opposed parallel relationship;

first capacitor means connected to be discharged through either of said thyristors to cause generation of a discharge tube ionization producing signal; and pulse shaping means for coupling said timer means output pulses simultaneously to the gates of said thyristors.

12. The apparatus of claim 11 further comprising:

means for sensing the current flow through a gaseous discharge tube through which the capacitive load discharges and generating a signal commensurate therewith; and means for delivering said signal commensurate with discharge tube current to said disabling means to cause disabling of said switch means when the discharge tube is in the ionized state.

13. The apparatus of claim 11 further comprising:

trigger storage capacitor means, said trigger storage capacitor means being charged simultaneously with a charging of the capacitive load; and means connecting said trigger storage capacitor means to said first capacitor means whereby said first capacitor means will be charged from said trigger storage capacitor means subsequent to each discharge of said first capacitor means through one of said thyristors.

14. The apparatus of claim 11 further comprising:

means for sensing the voltage across a load connected across said transformer means transformer secondary winding and for generating a signal commensurate therewith; and means for delivering a signal commensurate with load voltage as a second energizing signal to said disabling means whereby said switch means will be disabled whenever the voltage across the load exceeds a predetermined level.

15. The apparatus of claim 14 further comprising:

means for sensing the current flow through a gaseous discharge tube through which the capacitive load discharges and generating a signal commensurate therewith; and means for delivering said signal commensurate with discharge tube current to said disabling means to cause disabling of said switch means when the discharge tube is in the ionized state.

16. The apparatus of claim 14 wherein said voltage sensing means comprises:

voltage divider means connected in parallel with the load; and means for establishing a low resistance path in parallel with at least a portion of said voltage divider means when a predetermined voltage appears across the load.

17. The apparatus of claim 16 further comprising:

second switch means connected in parallel with a portion of said voltage divider means, the portion of said voltage divider means with which said second switch means is associated being included within and having less resistance than the portion of said voltage divider means connected in parallel with said means for establishing a low resistance path, the state of said second switch means controlling the voltage at which said low resistance path establishing means become operative.

18. The apparatus of claim 17 wherein said second switch means comprises a photocell.

19. The apparatus of claim 1 wherein said disabling means comprises:

a control amplifier, said control amplifier including a normally nonconductive output transistor, conduction of said control amplifier output transistor in response to delivery to said control amplifier of an energizing signal commensurate with switch means first semiconductive device current in excess of the predetermined level causing said control means second semiconductor device to be deprived of base drive whereby said second semiconductor device is rendered nonconductive.

20. The apparatus of claim 19 wherein said load is a capacitance subject to periodic discharge through a gaseous discharge tube and wherein said apparatus further comprises:

timer means for producing output pulses having a preselected repetition rate and duration; and means responsive to said timer means output pulses for causing ionization of the discharge tube whereby the capacitance will discharge therethrough.

21. The apparatus of claim 20 wherein said means for causing ionization of the discharge tube comprises:

a triac;

first capacitor means connected to be discharged through said triac to cause generation of a discharge tube ionization producing signal; and pulse shaping means for coupling the timer means output pulses to said triac whereby said triac is rendered conductive on the leading and trailing edges of said timer means output pulses.

22. The apparatus of claim 21 further comprising:

trigger storage capacitor means, said trigger storage capacitor means being charged simultaneously with a charging of the capacitive load; and means connecting said trigger storage capacitor means to said first capacitor means whereby said first capacitor means will be charged from said trigger storage capacitor means subsequent to each discharge of said first capacitor means through said triac.

23. The apparatus of claim 22 further comprising:

means for sensing the voltage across a load connected across said transformer means transformer secondary winding and for generating a signal commensurate therewith; and means for delivering said signal commensurate with load voltage as a second input signal to said disabling means whereby said switch means will be disabled whenever the voltage across the load exceeds a predetermined level.

24. The apparatus of claim 23 further comprising;

means connected to said voltage sensing means for sensing the ambient light conditions, said ambient light sensing means varying said predetermined voltage level as a function of the ambient lighting conditions.

25. The apparatus of claim 24 wherein said voltage sensing means comprises:

voltage divider means connected in parallel with the load; and means for establishing a low resistance path in parallel with at least a portion of said voltage divider means when a predetermined voltage appears across the load.

26. The apparatus of claim 25 further comprising:

second switch means connected in parallel with a portion of said voltage divider means, the portion of said voltage divider means with which said second switch means is associated being included within and having less resistance than the portion of said voltage divider means connected in parallel with said means for establishing a low resistance path, the state of said second switch means controlling the voltage at which said low resistance path establishing means become operative.

27. Apparatus for controllably and intermittently energizing a gaseous discharge tube of a warning light from a direct current source to cause the generation of groups of light pulses, the pulses within each group being closely spaced in time and the groups of pulses being separated in time by an interval which greatly exceeds the interval between pulses of each group, the gaseous discharge tube having an anode and a cathode and the warning light including a trigger voltage transformer associated with the discharge tube, said apparatus comprising:

a power transformer, said transformer having at least a primary winding, a secondary winding and a feedback winding;

blocking oscillator means, said oscillator means including a first controllable semiconductor device connected in series with said transformer primary winding and the direct current source, said semiconductor device having an emitter, a collector and a base, said oscillator means further including said transformer feedback winding, said first semiconductor device being periodically switched between conductive and non-conductive states at a first frequency to cause current flow through said transformer primary winding when said first semiconductor device is in the conductive state whereby said oscillator means will cause an alternating voltage to be induced in said transformer secondary winding;

means responsive to gating signals for selectively disabling said oscillator means, said disabling means establishing a conductive path between the base and emitter of said first semiconductor device when in the disabling mode;

first capacitor means connected to said transformer secondary winding for storing energy induced therein through operation of said oscillator means, said first capacitor means having first and second polarity terminals;

means for connecting the first polarity terminal of said first capacitor means to the anode of the gaseous discharge tube;

means for generating timing pulses at a second frequency, and second frequency being lower than said first frequency and said timing pulses having a predetermined duration;

means responsive to said timing pulses for generating a plurality of control pulses in response to each timing pulse;

means responsive to said control pulses for generating gaseous discharge tube trigger pulses, said trigger pulse generating means including nominally non-conductive solid state switch means responsive to said control pulse, said trigger pulse generating means further comprising second capacitor means connected in series with the trigger voltage transformer primary winding, switching of said switch means to the conductive state establishing a discharge path for said second capacitor means whereby a trigger voltage pulse of sufficient magnitude to cause conduction of the gaseous discharge tube will be induced in the trigger voltage transformer secondary winding, said first capacitor means discharging through the gaseous discharge tube when the tube is rendered conductive by a trigger voltage pulse;

means establishing a charging path for said second capacitor means, said charging path establishing means coupling said second capacitor means to said first polarity terminal of said first capacitor means;

means for limiting level to which said second capacitor means will be charged;

voltage sensitive means connected to said first capacitor means, said voltage sensitive means generating a first command signal when the voltage across said first capacitor means reaches a predetermined level; and means responsive to command signals generated by said voltage sensitive means for applying a gating signal to said disabling means to cause the disabling of said oscillator means.

28. The apparatus of claim 27 wherein said second capacitor means charge level limiting means comprises;

a zener diode connected in parallel with said solid state switch means.

29. The apparatus of claim 27 further comprising;

means for generating a second command signal for application to said gating signal applying means for causing said oscillator means to be disabled when said first capacitor means is being discharged.

30. The apparatus of claim 29 wherein said second capacitor means charge level limiting means comprises;

a zener diode connected in parallel with said solid state switch means.

31. The apparatus of claim 27 wherein said voltage sensitive means comprises:

voltage divider means connected in parallel with said first capacitor means; and a neon tube connected to said voltage divider and responsive to a voltage across a portion of said voltage divider means, said neon tube being rendered conductive when a predetermined voltage appears across said first capacitor means to thereby generate a said command signal.

32. The apparatus of claim 31 wherein said second capacitor means charge level limiting means comprises:

a zener diode connected in parallel with said solid state switch means.

33. The apparatus of claim 32 further comprising:

means for generating a second command signal for application to said gating signal applying means for causing said oscillator means to be disabled when said first capacitor means is being discharged.

34. The apparatus of claim 27 wherein said trigger pulse generating means switch means comprises:

a triac.

35. The apparatus of claim 34 wherein said means responsive to said timing pulses for generating said control pulses comprises:

differentiator means, said differentiator means generating a control pulse synchronized with the leading and trailing edges of each timing pulse.

36. The apparatus of claim 35 further comprising:

means for sensing the ambient light conditions, said light sensing means being connected to said voltage sensitive means for varying said preselected voltage level as a function of the ambient lighting conditions.

37. The apparatus of claim 35 comprising:

third capacitor means, said third capacitor means being charged simultaneously with the charging of said first capacitor means; and means connecting said third capacitor means to said second capacitor means whereby said second capacitor means will be charged from said third capacitor means subsequent to each discharge of said second capacitor means through said switch means.

38. The apparatus of claim 27 comprising:

third capacitor means, said third capacitor means being charged simultaneously with the charging of said first capacitor means; and means connecting said third capacitor means to said second capacitor means whereby said second capacitor means will be charged from said third capacitor means subsequent to each discharge of said second capacitor means through said switch means.

* * * * *